United States Patent [19]

Meisel, Jr.

[11] 4,189,010

[45] Feb. 19, 1980

[54] POWER ANGLING BULLDOZER ASSEMBLY

[75] Inventor: Thomas C. Meisel, Jr., Peoria, Ill.

[73] Assignee: Caterpillar Tractor Co., Peoria, Ill.

[21] Appl. No.: 873,043

[22] Filed: Jan. 27, 1978

[51] Int. Cl.[2] ..... E02F 3/76

[52] U.S. Cl. ..... 172/804

[58] Field of Search ..... 172/803, 804, 805, 806, 172/807, 809

[56] References Cited

U.S. PATENT DOCUMENTS

| | | | |
|---|---|---|---|
| 2,230,704 | 2/1941 | Sorensen | 172/802 |
| 2,485,407 | 10/1949 | Peterson | 172/803 |
| 2,634,519 | 4/1953 | Merz | 172/805 |
| 2,766,536 | 10/1956 | Perkins | 172/805 |
| 3,653,451 | 4/1972 | Fryrear | 172/804 |
| 3,662,841 | 5/1972 | Molby | 172/804 |
| 3,759,110 | 9/1973 | Davis | 172/805 X |
| 3,825,074 | 7/1974 | Stedman | 172/803 |
| 3,901,329 | 8/1975 | Eftefield | 172/804 |

*Primary Examiner*—Richard J. Johnson

*Attorney, Agent, or Firm*—Wegner, Stellman, McCord, Wiles & Wood

[57] ABSTRACT

A vehicle is constructed with a bulldozer blade and a pair of articulated push arms which may be folded or unfolded by operation of independently extendible hydraulic jacks to extend or retract the blade relative to the vehicle. The push arms have short and a long component which are pivotally interconnected with the short component being pivotally connected to the vehicle and the long component being pivotally connected to the blade. A mechanical stop prevents movement beyond a fully retracted position. Extendible jacks are also utilized to control the elevation, tilt and pitch of the blade and a stabilizing link is provided to resist lateral movement of the blade relative to the vehicle under load.

14 Claims, 5 Drawing Figures

POWER ANGLING BULLDOZER ASSEMBLY

BACKGROUND OF THE INVENTION

1. Field of the Invention

This invention relates generally to a bulldozer assembly and, more particularly, to a bulldozer assembly in which the length of the push arms which connect the bulldozer blade to the vehicle may be extended or retracted to angle the bulldozer blade.

2. Description of the Prior Art

Typically, vehicles which had the capability of providing an angled bulldozer blade utilized a C-frame assembly to support the blade and the connecting arms. The C-frame assembly was large, added considerable weight to the machine, and caused the machine to be heavily unbalanced. Further, the C-frame assembly positioned the bulldozer blade away from the front of the machine which sometimes generated load balance and distribution problems.

Prior art vehicles, which were equipped with bulldozer assemblies, had a blade and push arms which formed a U-shaped structure. These U-shaped structures were relatively weak in their ability to withstand side loads. As shown in Stedman et al U.S. Pat. No. 3,825,074 entitled "Interacting Bulldozer Stabilizer and Equalizer Bar," issued July 23, 1974 and assigned to the assignee of the present invention, the vehicle's ability to handle side loads could be enhanced by employing a single rigid stabilizing link pivotally coupled between the forward portion of the main frame of the vehicle and the bulldozer assembly. This so-called "tag link" resists relative lateral movement therebetween. However, this tag link could not conveniently be used with conventional type angle blades which were adjustable.

SUMMARY OF THE INVENTION

The present invention is directed to overcoming one or more of the problems set forth above.

According to the present invention, a vehicle is constructed to provide a lighter bulldozer assembly in which the blade may be moved to a greater number of different angular positions, while maintaining the bulldozer blade relatively close to the front of the vehicle for better load distribution and balance. Herein, an angularly adjustable bulldozer assembly connected to a vehicle includes a bulldozer blade disposed forwardly of the vehicle, a pair of articulated push arms on either side of the vehicle for connecting the blade to the vehicle and motor means connected between the articulated components of the push arms to control swinging of the push arms about a pivot connection so as to individually extend or retract one of the push arms.

In an exemplary embodiment of the invention, the push arms have forward and rearward link components with the rearward component pivotally connected to the main frame of the vehicle so as to be adapted to swing about a generally horizontal axis and with the forward component pivotally connected to the rearward component at a point spaced from the frame connection. Retraction of extendible hydraulic jacks connecting the forward and rearward components enables the rearward component to pivot rearwardly about the pivotal connection thereby drawing the forward component rearwardly and moving the bulldozer blade towards the vehicle. Similarly, extension of the hydraulic jacks causes the rearward link to swing forwardly about the pivotal connection to move the bulldozer blade forwardly away from the vehicle.

In a preferred embodiment of the invention, a stabilizing link has one end pivotally joined at the forward end of the vehicle spaced from the central axis of the vehicle, extending transversely across the front of the vehicle and pivotally joined to the forward end of the forward component of one of the push arms. The stabilizing link resists lateral movement of the bulldozer blade assembly and causes the forward end of the push arm to which it is connected to swing generally about the frame connection and causes the other push arm, which is not connected to the stabilizing link, to swing generally about the push arm connection.

BRIEF DESCRIPTION OF THE DRAWING

The details of the construction and operation of the invention are more fully described with reference to the accompanying drawing which forms a part hereof and in which like reference numerals refer to like parts throughout.

In the drawing.

DESCRIPTION OF THE PREFERRED EMBODIMENT

Figure 1:
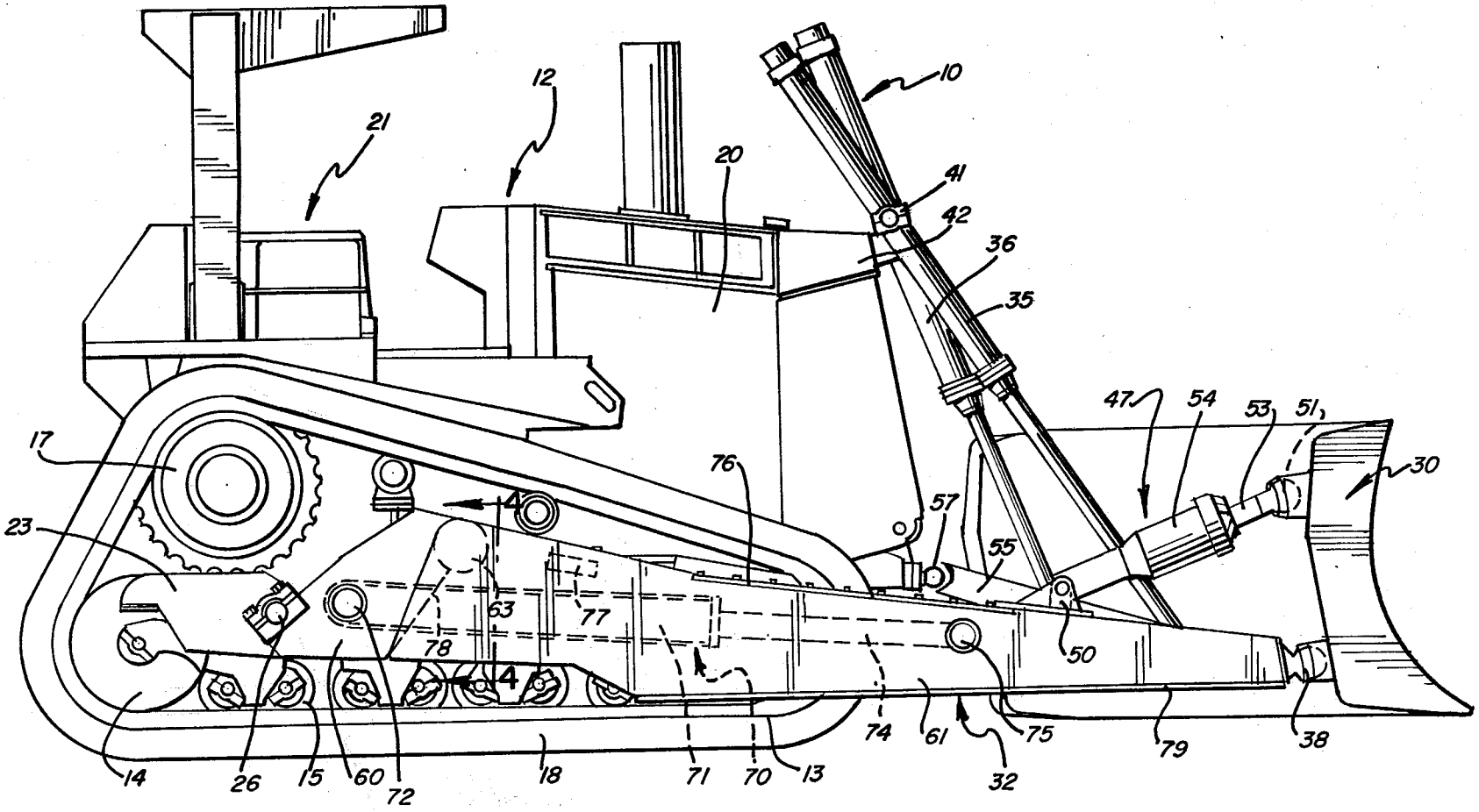
FIG. 1 is a right side elevational view of a tracked vehicle in which the right push arm is extended to angle the bulldozer blade to the left.

Referring to the drawing, and in particular to FIG. 1, a track-type vehicle, generally designated 10, is shown and includes a main frame 12, front and rear idlers 13 and 14, a plurality of track rollers 15, a drive sprocket 17, and an endless track 18 which is driven by the drive sprocket 17 to effect travel of the vehicle 10 along the ground. The main frame 12 supports a conventional engine housing 20 and an operator station 21. The vehicle main frame 12 and its associated upper structure is supported by a pair of generally parallel forwardly extending track roller frames 23 and 24.

Figure 2:
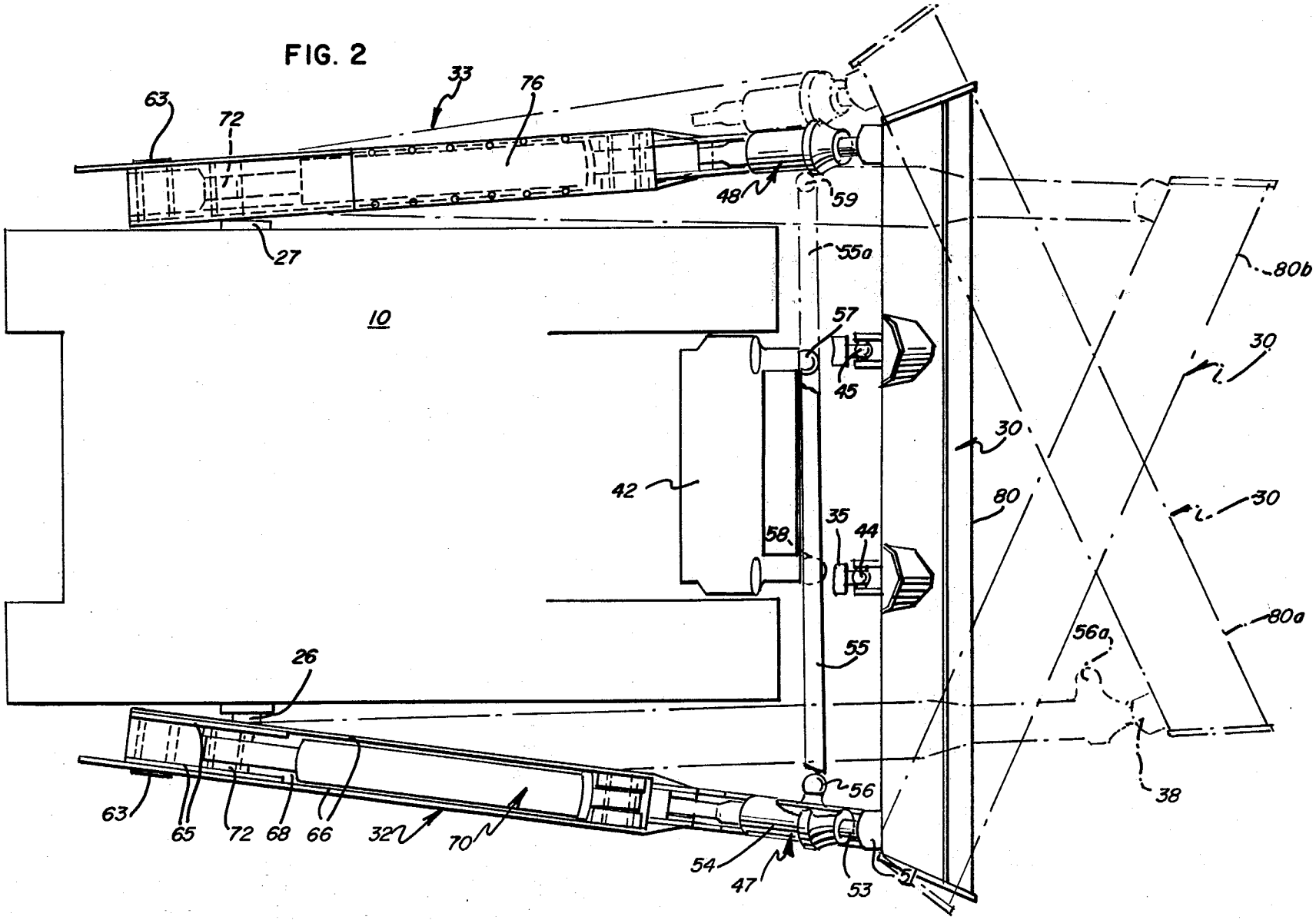
FIG. 2 is a top plan view of the vehicle shown in FIG. 1 illustrating in solid lines the bulldozer blade in a transverse position and in phantom lines the bulldozer blade at left and right angled positions.
Figure 3:
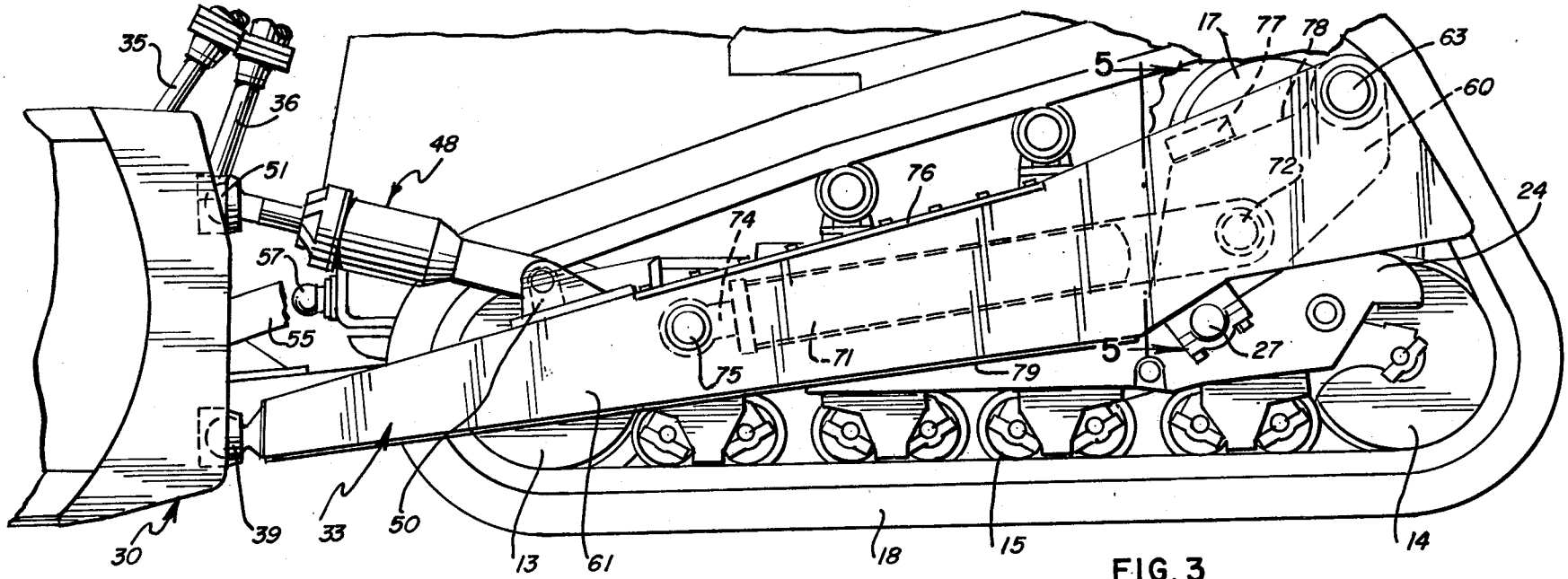
FIG. 3 is a partial left side elevational view of the tracked vehicle shown in FIG. 1.
Figure 5:
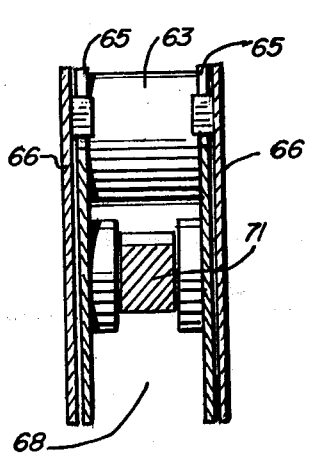
FIG. 5 is a cross-sectional view of the push arm assembly taken along line 5—5 of FIG. 3.
Figure 4:
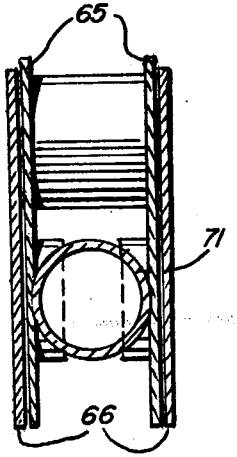
FIG. 4 is a cross-sectional view of the push arm assembly taken along line 4—4 of FIG. 1.

Each of the track roller frames 23 and 24 supports an outwardly extending push arm mounting ball joint 26 or 27. As best seen in FIGS. 1-3, an earth-moving bulldozer blade 30 is carried forwardly of the vehicle 10 by a pair of generally parallel articulated push arms 32 and 33 and by a pair of extendible lifting jacks 35 and 36. The push arms 32 and 33 are preferrably mounted to the lower rear of the blade 30 by self-aligning joints 38 and 39, which may be of the ball or clevis types, and are pivotally mounted to the ball joints 26 and 27 at the rear of the vehicle 10 on either side of the main frame 12. The lifting jacks 35 and 36 are universally supported above the bulldozer assembly in a pair of trunnion-type implement mounting universal joints 41 which are disposed on either side of an open box cross frame 42. The lifting jacks 35 and 36 have their forward lower extremities connected to the rear of the bulldozer blade 30 by a pair of laterally spaced ball joints 44 and 45. The bulldozer blade 30 is held in a generally erect position by a pair of tilt braces 47 and 48 connected as by pivot pins and brackets 50 to the push arms 32 and 33 and by ball and socket joints 51 to the upper rear portion of the bulldozer blade 30. The tilt braces 47 and 48 are each formed from a piston rod 53 which is hydraulically extendible from a cylinder 54.

A single rigid stabilizing link 55 has one end pivotally coupled to the bulldozer assembly by means of a ball joint 56 carried by the push arm 32. The opposite end of the stabilizing link 55 is pivotally coupled to the forward portion of the main frame 12, i.e., cross frame 42, by means of a ball joint 57 at one side of the vehicle 10 so that it is laterally offset from the central longitudinal axis of the vehicle 10. The link 55 is disposed generally transversely of the vehicle 10 and extends from the ball joint 57 across the main frame 12 to the ball joint 56 which is positioned adjacent the pivotal connection between the push arm 32 and the bulldozer blade 30. A stabilizing link 55*a* may optionally be connected between a ball joint 58 carried by the cross frame 42 and by ball joint 59 carried by the forward portion of push arm 33. The optional stabilizing link 55*a* and ball joints 58,59 are shown in phantom and would only be used when link 55 and ball joints 56,57 are not used.

Both of the push arms 32 and 33 are similarly constructed and include a short rearward link component 60 and a long forward link component 61 pivotally joined together by suitable means such as pivot pin 63. The short and long links 60 and 61 are respectively defined by laterally spaced plates 65 and 66. The short link 60 is pivotally connected to the ball joint 26 or 27 at a rearward portion of the vehicle 10 at a point thereon remote from its pivotal connection to the long link 61 at pin 63. The long link 61 is connected at the opposite end of its pivotal connection to short link 60, via the ball joint 38 or 39, to the lower end of the bulldozer blade 30. As best seen in FIG. 2, the spaced plates 66 of the long link 61 are placed on either side of the spaced plates 65 of the short link 60 to thereby define an open space 68 adapted to receive a double-acting hydraulic motor or jack 70. As shown in FIGS. 1 and 3, the extendible jack 70 has a hydraulic cylinder 71 joined to the short link 60 by a pivot pin 72 extending between the spaced plates 65 and a piston rod 74 connected to the long link 61 by a pivot pin 75 extending between the spaced plates 66. Top cover plates 76 are bolted to the top edges of the plates 66 and bottom cover plates 79 are bolted to the bottom edges of the plates 66 to form the box-shaped link 61. It is to be understood that the cylinder 71 could be joined to the long link 61 and the rod 74 joined to the short link 60 without departing from the invention.

In FIG. 1, the one push arm 32 has been moved to an extended position by extending the hydraulic jack 70. The extended position of jack 70 is also illustrated in phantom in FIG. 2 as 80*a*. Since the centerline of the hydraulic jack 70 is in spaced relation to the pivotal connection 63, upon retraction of the hydraulic jack 70 the short link 60 is pivoted about the ball joint 26 in a counterclockwise direction as seen in FIG. 1 to fold the short and long links 60 and 61 and place the blade 30 in the solid line position 80 as shown in FIG. 2. When the hydraulic jack 70 is fully retracted, the push arm 32 will be folded in a retracted position, such retracted position being the same as illustrated by arm 33 in FIG. 3. In the retracted position, the short link 60 and long link 61 nest to foreshorten the effective length of the arm 32 so that the right-hand side of the blade 30 is moved rearwardly toward the front of the vehicle 10. A mechanical stop 77 extends between the plates 66 and bears against the edge 78 of the short link 60 to interfere therewith and prevent further rotation of the short link 60 about the ball joint 26 and pin 63 when the push arm 32 reaches a fully retracted position.

Referring to FIG. 2, the operation of the stabilizing tag link 55 and the extendible push arms 32 and 33 will be described in further detail. In the position of the blade 30, shown in solid lines at 80, both of the push arms 32 and 33 will be fully retracted to place the blade 30 in relatively close transverse relationship to the vehicle 10 and extending crosswise to the main frame 12. When the right push arm 32 is extended, the blade 30 moves to the phantom position 80*a*, the stabilizing link 55 will have swung about the ball joint 57 and the push arm 32 will have swung slightly counterclockwise laterally toward the vehicle while the push arm 33 will swing laterally outward from the vehicle 10. As the push arm 32 is extended, the end of the link 55 at the ball joint 56 will swing generally about the fixed ball joint 57 and, if the lift cylinder 35 is not elongated, the right side of the blade 30 will be moved upward somewhat. When the desired angled left position is reached, tilt and pitch adjustment may be made by operating the lifting jacks 35 and 36 or the tilt braces 47 and 48, to reposition the bulldozer blade 30 as desired. When the left push arm 33 is extended and the right push arm 32 is held in the retracted position to angle the bulldozer blade 30 right, as shown in phantom at 80*b* in FIG. 2, the push arm 33 will swing slightly in a clockwise direction generally about the ball joint 27. The last-named clockwise direction of movement of the arm 33 and, likewise, arm 32 will be caused by the tag link 55 connections at 57 and 56.

With the push arm 32 extended, the push arm 33 may also be extended. As a result of the extension of push arm 33 when the push arm 32 is in extended position, the tag link 55 will hold arm 32 fixed so that the arm 33 will swing outward (counterclockwise in FIG. 2) about the pivot 27 so that the blade in the extended straight across position will be offset to the left relative to the retracted straight across solid line position 80 of FIG. 2. Similarly, when the push arm 33 is in extended position, retraction of the push arm 32 will cause the blade 30, push arm 32 and push arm 33 to move laterally to the right (arms 32,33 pivoting clockwise about the pivots 26,27) due to tying effect of the stabilizing tag link 55.

The utilization of two tilt cylinders 54 permits the operator to adjust both the tilt and the pitch of the blade 30. Using only one cylinder will permit a tilt adjustment of the bulldozer blade 30.

The embodiment of the invention in which an exclusive property or privilege is claimed is defined as follows:

1. In a vehicle having a frame and means for driving the vehicle along the ground, a bulldozer assembly comprising:

a bulldozer blade forwardly of the vehicle;

a pair of push arms one on either side of the vehicle, each push arm having first and second components pivotally interconnected and motor means connected between said first and second components in spaced relation from the pivotal connection for controlling swinging movement of said first and second components relative to each other in a common plane, said first component being pivotally connected to the frame for swinging movement about a generally horizontal axis from a position extending toward the rear of the frame to a position extending toward the front of the frame, and said second component being pivotally connected to said blade with a portion of said second component overlapping said first component when said first component extends toward the rear of the frame, each one of said push arms being independently operable relative to the other of said push arms, one of said motor means being extended to pivot said first component from the rearward overlapped position to a forward position to move said blade to an angled position oblique to the vehicle and both of said motor means being operable to extend or retract the components of both of said push arms to place said blade in a position crosswise to the vehicle; and means interconnecting the main frame and the bulldozer assembly for resisting relative lateral movement therebetween.

2. The bulldozer assembly of claim 1 wherein said first and second components are pivotally interconnected by pivot means allowing relative swinging movement about a generally horizontal axis.

3. The bulldozer assembly of claim 2 wherein each of said motor means is a jack having a hydraulic cylinder and an extendible piston rod, one of said cylinder and rod being pivotally connected to one of said first and second components with the other of said cylinder and rod being pivotally connected to the other of said first and second components.

4. In a vehicle having a frame and means for driving the vehicle along the ground, a bulldozer assembly comprising:

a bulldozer blade forwardly of the vehicle; and a pair of push arms one on either side of the vehicle, each push arm having first and second components pivotally interconnected and motor means connected between said first and second components in spaced relation from the pivotal connection for controlling swing movement of one of said push arms independently of the other of said push arms, said first component being pivotally connected to the frame for swinging movement about a generally horizontal axis, and said second component being pivotally connected to said blade, whereby operation of one of said motor means to move the respective push arm to an extended position places said blade in an angled position oblique to the vehicle and whereby operation of both of said motor means to move both of said push arms to a retracted or to an extended position places said blade in a position crosswise to the vehicle, and a stabilizing link pivotally connected to the frame adjacent the forward end and at one side thereof, extending transversely across the front of the vehicle and pivotally connected to the bulldozer assembly at the opposite side of the vehicle.

5. The bulldozer assembly of claim 4 wherein said stabilizing link is connected to the push arm at said opposite side of the vehicle at a point adjacent the pivotal connection between the push arm and said blade.

6. The bulldozer assembly of claim 4 further including second motor means connected between the frame and the bulldozer assembly for controlling elevation of said blade, said second motor means being pivotally connected to the frame at a position above said bulldozer assembly.

7. The bulldozer assembly of claim 6 wherein said first components are connected to the frame by a universal joint and said second motor means comprises two independent extendible jacks with said jacks being pivotally connected to said bulldozer assembly at laterally spaced points thereon, whereby operation of said jacks lifts or lowers said blade relative to the ground.

8. The bulldozer assembly of claim 4 wherein said second components are connected to said blade adjacent the bottom thereof, and further including bracing means pivotally connected to each push arm and to said blade adjacent the top thereof.

9. The bulldozer assembly of claim 8 wherein one of said bracing means is a motor having a hydraulic cylinder pivotally connected to one of said second component and blade and an extendible piston rod pivotally connected to the other of said second component and blade.

10. The bulldozer assembly of claim 9 wherein both of said bracing means are extendible hydraulic motors for controlling the pitch and tilt of said blade relative to said push arms.

11. In a vehicle having a frame and means for driving the vehicle along the ground, a bulldozer assembly comprising:

a bulldozer blade forwardly of the vehicle;

a pair of push arms one on either side of the vehicle for connecting said blade to the vehicle, each of said push arms including a rear component pivotally mounted to the frame to swing about a first generally horizontal axis, a forward component having a rear portion pivotally connected to the rear component to swing about a second generally horizontal axis spaced from said first axis and a front portion pivotally connected to said blade, and first extendible motor means connected between the rear and forward components and being in spaced relation from the pivotal connection therebetween for controlling the swinging movement of said rear and forward components such that retraction of the first motor means collapses its respective push arm and extension of the first motor means extends its respective push arm;

stabilizing means interconnecting the main frame and the blade for resisting relative lateral movement therebetween;

second extendible motor means connected between the frame and said blade for controlling the elevation of said blade; and third extendible motor means connected between each push arm and said blade for controlling the tilt of the blade.

12. The bulldozer assembly of claim 11 wherein said rear component is defined by a pair of lateral spaced plates, said forward component is defined by a pair of laterally spaced plates disposed on either side of said rear component, and said first motor means includes a double-acting hydraulic jack having a cylinder and an extendible piston rod, each of said hydraulic jacks having its piston rod pivotally connected to said forward component between its respective spaced plates and having its cylinder connected to the rearward component between its respective spaced plates.

13. The bulldozer assembly of claim 12 further including a crosspiece between the plates of said forward component adapted to abut said rear component when the respective push arms are folded to prevent further retraction thereof.

14. The bulldozer assembly of claim 11 wherein said second motor means comprises a pair of hydraulic jacks pivotally connected to the frame at a position above said bulldozer assembly and to said blade at laterally spaced points thereon, said forward components are connected adjacent the bottom of said blade, said third motor means comprises a pair of hydraulic jacks one pivotally connected to each of said forward components and to said blade adjacent the top thereof, and said stabilizing means is a rigid link pivotally connected to the frame adjacent the forward end and at one side thereof and to the forward component of the push arm at the opposite side of the vehicle at a point adjacent the pivotal connection between the push arm and said blade.

* * * * *